United States Patent [19]

Allen, Sr.

[11] Patent Number: 5,033,703

[45] Date of Patent: Jul. 23, 1991

[54] RING ASSEMBLIES FOR SUPPORTING REFUSE BAGS

[76] Inventor: Johnny G. Allen, Sr., P.O. Box 3667, Albany, Ga. 31706

[21] Appl. No.: 565,700

[22] Filed: Aug. 13, 1990

[51] Int. Cl.[5] ..... A63B 55/04

[52] U.S. Cl. ..... 248/97; 248/95; 248/175; 248/907

[58] Field of Search ..... 248/907, 95, 97, 98, 248/99, 100, 101, 175, 150, 154, 153; 220/404; 141/314, 391

[56] References Cited

U.S. PATENT DOCUMENTS

| | | | |
|---|---|---|---|
| D. 276,755 | 12/1984 | Eads et al. | D34/26 |
| 313,515 | 3/1885 | Parker | 248/99 |
| 432,966 | 7/1890 | Allen | 248/99 |
| 611,498 | 9/1898 | Lyon | 248/97 |
| 936,975 | 10/1909 | Abel | 248/99 X |
| 972,870 | 10/1910 | Kandlbinder | 248/99 |
| 1,548,986 | 8/1925 | Donovan | 248/99 |
| 3,079,119 | 2/1963 | Brooks | 248/907 X |
| 3,135,391 | 6/1964 | Umstead | 248/907 X |
| 3,141,644 | 7/1964 | Baird | 248/907 X |
| 3,684,225 | 8/1972 | Crawford et al. | 248/99 |
| 3,754,771 | 8/1973 | Shagoury | 248/98 X |
| 3,841,592 | 10/1974 | Witten | 248/98 X |
| 3,933,328 | 1/1976 | Michelbrink | 248/907 X |
| 3,991,961 | 11/1976 | Platzer, Jr. | 248/99 |
| 3,992,034 | 11/1976 | Smith, Sr. et al. | 248/98 X |
| 4,124,185 | 11/1978 | Preisinger | 248/98 |
| 4,376,520 | 3/1983 | Wetherington | 248/150 X |
| 4,498,652 | 2/1985 | Malik | 248/99 |
| 4,579,307 | 4/1986 | Malik | 248/99 |
| 4,702,445 | 10/1987 | Ivory | 248/100 |
| 4,708,307 | 11/1987 | Daigle | 248/97 |
| 4,867,401 | 9/1989 | Graff | 248/99 |
| 4,899,967 | 2/1990 | Johnson | 248/99 X |
| 4,940,201 | 7/1990 | Kurth | 248/101 |
| 4,946,118 | 8/1990 | Hastings | 248/101 X |
| 4,948,075 | 8/1990 | Allen | 248/97 |

FOREIGN PATENT DOCUMENTS

| | | | |
|---|---|---|---|
| 0163167 | 6/1955 | Australia | 248/97 |

*Primary Examiner*—Ramon O. Ramirez
*Attorney, Agent, or Firm*—Dowell & Dowell

[57] ABSTRACT

Ring assemblies for supporting one or more refuse, garbage or lawn and garden bags so that such bags are retained in an open configuration and vertically stabilized to thereby facilitate the filling of the bags and wherein the assemblies include primary ring members which are cantilevered from support racks having horizontally offset support members and wherein the bags are locked to the primary ring members by secondary ring members that are selectively supported by the primary ring members.

10 Claims, 4 Drawing Sheets

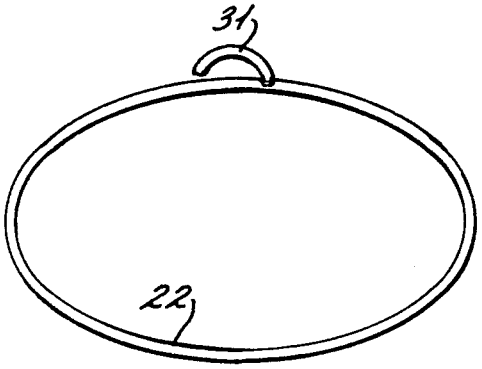
Fig. 5
Fig. 6
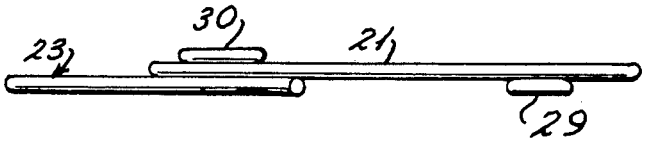
Fig. 7
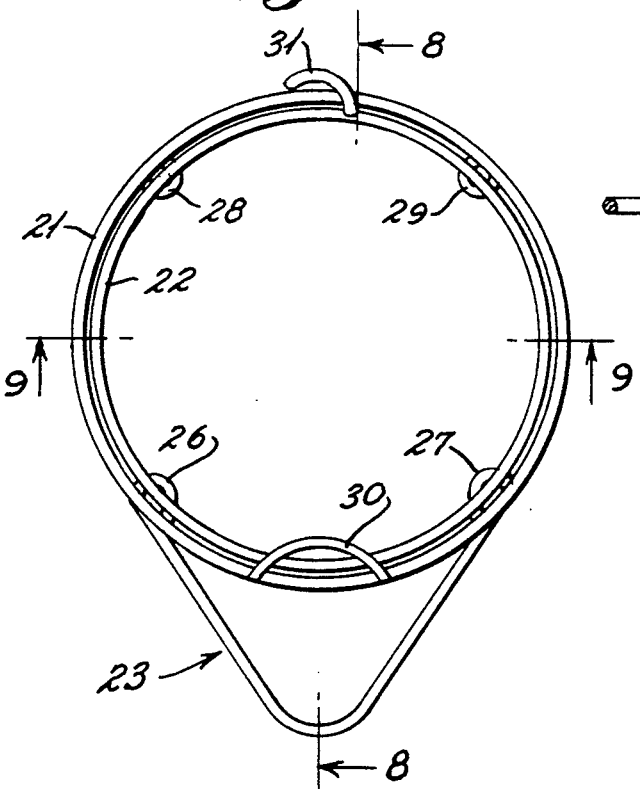
Fig. 8
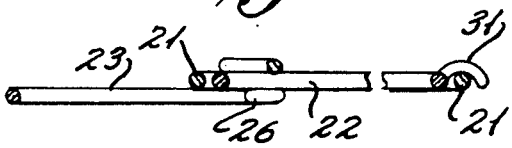
Fig. 9
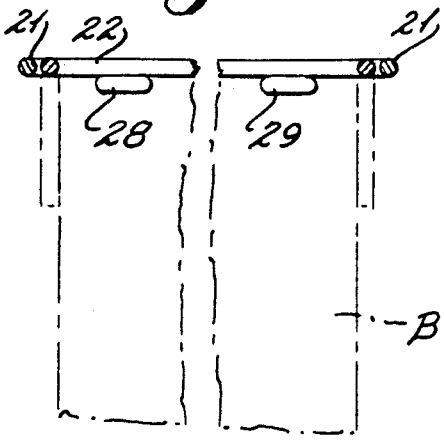

Fig. 10
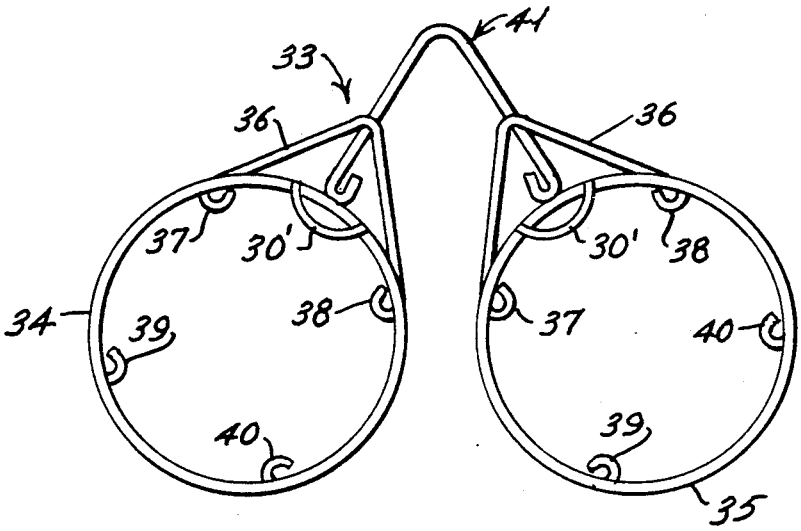
Fig. 11
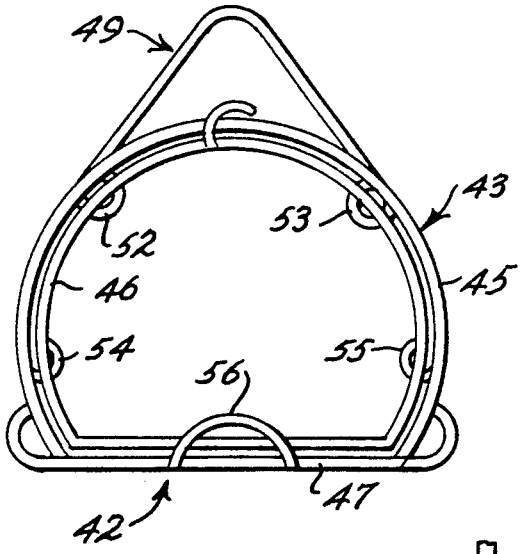
Fig. 12
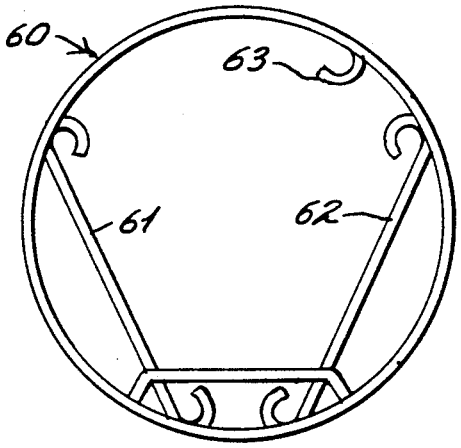
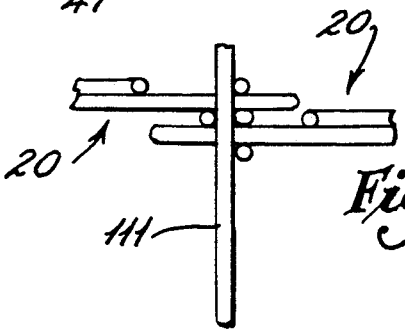
Fig. 17

RING ASSEMBLIES FOR SUPPORTING REFUSE BAGS

BACKGROUND OF THE INVENTION

1. Cross Reference to Related Applications

This application is related to applicant's co-pending application, Ser. No. 07/380,447, filed July 17, 1989, now U.S. Pat. No. 4,948,075 entitled "Retention Ring Assemblies for Supporting Refuse Bags".

2. Field of the Invention

This invention is generally directed to bag holders of the type which are utilized to support flexible bags in an open configuration so as to facilitate the filling of the bags and more specifically to ring assemblies for supporting one or more refuse, garbage or lawn and garden bags relative to a support structure in such a manner that the rings which retain the bags open may be easily placed within support racks wherein the ring assemblies are cantilevered from the racks and are horizontally stabilized without the need for providing additional fastening elements. The racks include at least one pair of vertically spaced ring support members which are disposed in generally parallel planes and which may be horizontally offset with respect to one another. Brackets are mounted to the support ring assemblies so as to extend between the support members of a rack so that the weight of the ring assemblies is utilized to secure the rings within the racks. In this manner, the ring assemblies may be removed from the support racks by simply elevating the outer portion of the ring assemblies which is cantilevered with respect to the spaced support members and thereafter withdrawing the assemblies therefrom.

In one embodiment of the present invention, the racks include one or more vertical support posts to which are mounted at least one pair of spaced support members which are vertically offset in generally parallel relationship with one another.

In another embodiment of the present invention, the support racks may be formed as a vertical ladder with hook elements which support the racks relative to fences, doorknobs, refuse containers, lawn mower handles and similar structures so that the ring assemblies may be placed in an area where it is necessary to provide support for a refuse or lawn and garbage bag.

In each embodiment, the ring assemblies include a primary ring member having an outwardly extending bracket which is engageable between the vertically spaced support rods of the racks. Each primary ring also includes one or more inwardly extending lugs and at least one inwardly extending lock. To secure a bag to the primary ring, each assembly further includes a smaller concentrically oriented secondary ring which when placed intermediate the lock and lugs of the primary ring will be securely seated with respect thereto and will the bag therebetween. The secondary rings may also include a hooked projection which will engag the outer periphery of a primary ring when supported by the primary ring.

In some embodiments, each ring assembly may include a third way that may be used to act as a retainer to anchor a covering material over the open mouth of a bag supported between the primary and supplemental rings.

History of the Related Art

Over the years there have been numerous structures designed and constructed for facilitating the use of various types of bags including garbage bags, lawn and garden bags and the like. The opening to such flexible bags and containers is often difficult to retain open while loading materials into the bags. This is particularly tru when armfuls of leaves, cut grass, weeds and the like are to be loaded within the bags for subsequent disposal. Some early examples of ring type structures which operate as bag holders are disclosed in U.S. Pat. Nos. 313,515 to Parker, 432,966 to Allen, 611,498 to Lyon and 1,548,986 to Donovan. In each of these prior art bag holders, a ring element is provided which is secured to a base portion that extends from the ring element or semi-circular ring element to a support which may be selectively secured to a given surface. In the reference to Parker, the ring or bag holder must be uniquely configured so as to be engageable over a support surface an therefore is provided with inverted U-shaped end portions which are joined by a connecting bracket. The U-shaped end portions may be mounted over a rail or other element so that the bag holder may be suspended horizontally with respect thereto. Such a structure is limited in its usefulness in that an appropriate horizontal support must be available on which the U-shaped mounting portions of the bag holder may be selectively seated so as to retain the ring portion of the bag holder in a selected horizontal position.

In the structure disclosed in the reference to Allen, a generally U-shaped bag holder element is selectively inserted within a pair of adjustable brackets which may be disposed over a horizontal rail in a manner similar to that disclosed in the reference to Parker. Again, the use of the bag holder is limited to a specific type of support surface which is available.

In the reference to Lyon, a generally circular shaped bag holding element is mounted to a special bracket which is suspended from a hook type of support which is specifically provided to support the bracket and ring relative to a base. With this type of structure, the ring element must again be provided with a fixed type of mounting bracket that is secured to the ring such that the bracket extends outwardly of the plane of the ring. In view of the foregoing, whenever the ring element is not in use, the support brackets will make stacking of the ring element difficult. Further, only a single bag may be supported at any one time.

In the reference to Donovan, a ring shaped element is mounted to a generally U-shape mounting bar which is fitted within an especially configured bracket that may be secured to a vertical support surface With this structure, there is no provision for altering the vertical placement of the ring assembly while using the horizontal support of the assembly and there is also no provision for providing for the support of a plurality of ring assemblies by a single rack.

A variation of bag holder is disclosed in U.S. Pat. 972,870 to Kandlbinder. In this type of bag holder, as opposed to using a circular or ring element to support the opening of the bag, a spring loaded wire member is provided having a pair of outwardly extending arms which are yieldable with respect to one another. The arms are engageable along opposite sides of the bag so as to deflect the bag outwardly. This type of holder will tend to provide an uneven opening for the mouth of the bag as opposed to ring type holders. In addition, a special type of support must be provided to retain the end of the spring arms relative to a given surface. Another wire rack type configuration for supporting bags in an open configuration is disclosed in U.S. Pat. No. 4,498,652 to Malik. In this configuration, a generally rectilinear wire frame is supported by a pair of hook elements that are secured to the interior door of a cabinet or other structure so that the bag may be supported from the door in an open configuration. With this type of structure, the mounting of the rack with respect to the door requires that some modification be made to the door such as by providing securing elements for engaging the ends of the rack to the door. Such a fixed mounting arrangement may present drawbacks to the use of the bag holder.

In addition to the foregoing, carriers for bag holders have also been made so that the bags supported by the holders may be manipulated without requiring an individual to lift and tote the bag. In U.S. Pats. 3,754,771 to Shagoury and 4,124,185 to Preisinger, bag holders are disclosed which are mounted to transport dollies. The transport dollies are provided with wheels so that the dollies may be easily transported across a lawn or yard. With these holders, a ring element is either fixedly mounted, as in the case of the patent to Shagoury, to the dolly frame or is removably mounted as is disclosed in the patent to Preisinger.

In order to overcome many of the problems and limitations found in prior art bag holders, in applicant's co-pending U.S. patent application Ser. No. 07/380,447, filed July 17, 1989, ring assemblies for supporting bags are disclosed wherein single rings are mounted between vertically and horizontally offset support members of a support rack. The structures disclosed not only simplified the mounting rings but also provided for increased utility of the holders by providing racks which could suppor a plurality of rings in numerous environments. However, the ring assemblies do not provide structures for locking or retaining bags in an open configuration but relied upo the use of separate clips.

Some additional examples of prior art bag holders are disclosed in U.S. Pat. Nos. 276,755 to Eads et al., 3,991,691 to Platzer, Jr., 3,684,225 to Crawford et al., 4,579,307 to Malik and 4,702,445 to Ivory. In view of the foregoing, there are several areas in which many prior art bag holders do not provide sufficient flexibility to allow their use in environments where it is not possible to effectively fixedly or permanently mount the bag holders to a support structure and wherein the number of bags which can be supported at any one time is limited to a single bag.

SUMMARY OF THE INVENTION

This invention is directed to ring assemblies for supporting one or more refuse, garbage or lawn and garden bags so the bags are retained in an open configuration and stabilized vertically with respect to an existing support structure such as a fence, door, garbage can, telephone pole or other post, lawn mower or other utility vehicle and wherein the ring assemblies include mounting racks for selectively receiving the bag support ring assemblies which are cantilevered from the racks in such a manner that the assemblies may be conveniently installed and/or removed without the use of supplemental clamps. The racks incorporate at least one pair of vertically spaced support or abutment members which are horizontally and vertically offset with respect one another. The vertical spacing between the abutment members may be varied in order to change the incline of the bag support ring assemblies with respect to the racks.

In each embodiment, the ring assemblies include a primary ring and a secondary removable inner concentric ring between which the edges of a bag may be selectively received to thereby retain the bag in an open configuration. At least one locking member extends inwardly of the primary ring and thereby retains the secondary ring in position relative to the primary ring. A mounting bracket having at least two outwardly extending arm portions is mounted to the primary rings and extends generally parallel thereto so that the ring assemblies may be easily and conveniently stacked upon one another when not in use. The primary rings also include lugs for supporting the secondary rings within the primary rings.

In some embodiments of the present invention, one or more hooks may be secured to the support racks so that the racks may be suspended from an existing structure such as a fence, doorknob or the like. In another embodiment of the present invention, a hanger element may be secured to the support racks so that the support racks may be mounted from the handle of a conventional lawn mower, garden tractor or garbage container.

In yet a further embodiment of the present invention, the support racks may include a plurality of support or abutment members which can be used to retain a plurality of ring assemblies.

In other embodiments, two ring assemblies may be mounted to a common secondary bracket so that the assemblies may be simultaneously mounted to a support bracket

BRIEF DESCRIPTION OF THE DRAWINGS

FIG. 5 is an enlarged perspective view of the secondary or supplemental ring used to bind trash bags to the primary rings of the present invention.

FIG. 6 a side elevational view of the primary ring of FIG. 4.

FIG. 7 is a top plan view of one of the ring assemblies of the present invention.

FIG. 8 is a partial cross-sectional view taken along lines 8—8 of FIG. 7.

FIG. 9 is a partial cross-sectional view taken along lines 9—9 of FIG. 7.

FIG. 10 is a top plan view of a modified primary support ring.

FIG. 11 is a top plan view of another embodiment of a ring assembly.

FIG. 12 is a top plan view of a third ring which may be used to retain a cover over the ring assemblies of the present invention.

FIG. 17 is a partial cross sectional view taken along lines 17—17 of FIG. 16 showing opposing ring assemblies being mounted thereto.

DESCRIPTION OF THE PREFERRED EMBODIMENT

Figure 1:
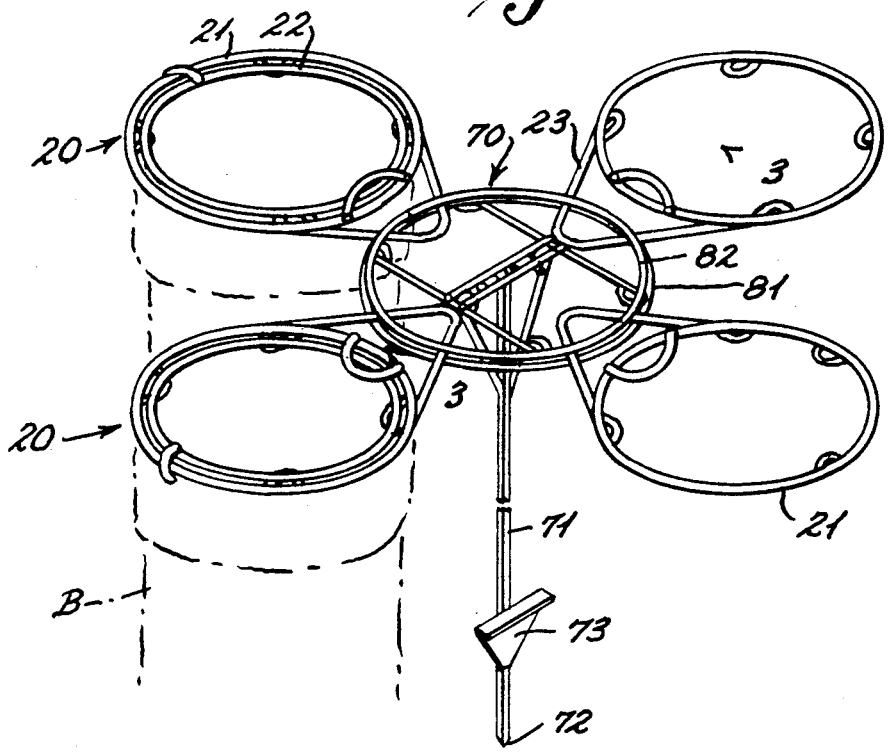
FIG. 1 is a perspective view of a first embodiment of the present invention which includes a ground insertable rack having a pair of circular support members and to which are mounted four ring assemblies for supporting refuse bags. In the drawing figures, two of the ring assemblies are shown without their secondary bag retaining rings.

With continued reference to the drawings, each of the refuse bag holders of the present invention incorporates a mounting rack and one or more ring assemblies. The mounting racks and ring assemblies may vary from embodiment to embodiment as will be described in greater detail hereinafter, however the operative characteristics are generally the same for each refuse bag holder.

With specific reference to FIGS. 4–7 of the drawings, each of the ring assemblies 20 includes an outer or primary ring member 21 and a concentric secondary inner ring member 22. The primary ring 21 includes an outwardly extending bracket 23 which is generally V-shaped having arm portions 24 and 25. The inner ends 26 and 27 of the arm portions extend beneath the ring 21 so as to provide two support lugs or seats upon which the inner ring may be selectively supported. The primary ring 21 also includes a pair of inwardly extending additional lugs or seats 28 and 29 which also support the inner ring 22.

In order to lock the inner rings relative to the outer rings, each primary ring includes at least one lock 30 which is in the form of a U-shaped member which extends inwardly of ring 21 so as to be generally parallel to but in vertically spaced relationship to the periphery of the ring 21. In this manner, when a secondary ring is slipped between the lock and the underlying lug seats 26 and 27, the ring 22 will be retained in position. To provide additional engagement between the rings 21 and 22 each inner ring 22 may include a hook member 31 which extends outwardly and downwardly therefrom so as to be engaged over the outer ring 21 when the ring 22 is seated with respect thereto. In use, once a bag (B) is positioned within a primary ring 21 with the open ends of the bag drooped outwardly thereof, a secondary ring 22 is slipped beneath the lock 30 and seated on the lugs of the primary ring. By sliding the secondary ring 22 relative to the primary ring 21, the hook 31 of the secondary ring will engage the periphery of the primary ring remote from the lock 30 as is shown in FIGS. 7 and 8.

The lock members 30 may be utilized as handles when the ring assembly has been removed from the mounting rack in order to facilitate the transportation of a bag which has been filled with debris. Although one lock member is shown in the drawings, it is possible that additional locking members could be provided as is necessary. The mounting of the ring assemblies to support racks will be discussed hereinafter.

With particular reference to FIG. 10, another embodiment of ring assembly 33 is disclosed which incorporates a pair of primary rings 34 and 35, each of which is structured identically to the primary rings 21 whown in the embodiments of the invention shown in FIGS. 4–7. Each primary ring 34 and 35 includes a bracket 36 having inner ends 37 and 38 which act as lugs or seats for a secondary or inner ring (not shown) and also includes spaced lugs 39 and 40. The rings 34 and 35 are joined by a supplemental V-shaped bracket 41 having arm portions which are welded to the brackets 36 and rings 34 and 35. Locks 30' (similar to locks 30) are provided to secure inner rings (such as 21) relative to the primary rings 34 and 35. In use, the ring assembly 33 will be slectively mounted to a support rack as will be discussed in greater detail.

Another embodiment of bag support ring assembly 42 is disclosed in FIG. 11. In this embodiment, both the primary ring 43 and secondary or inner ring 44 are configured so as to have an arcuate segment 45 and 46, respectively, and a straight segment 47 and 48, respectively. As with the previous embodiment, a V-shaped bracket 49 is welded to the primary ring 43. The bracket includes arm portions 50 and 51 and inner ends 52 and 53 which function as seats or lugs upon which the inner ring 44 is selectively seated. The primary ring 43 also includes a pair of inwardly spaced lugs 54 and end 55 which also support the inner ring 44. In this embodiment, a U-shaped lock 56 is welded to the straight segment 47 of the primary ring. The lugs and lock are vertically spaced a distance substantially equal to the thickness of the inner ring so that when the inner ring is placed in position, the inner ring will be confined therebetween. The inner ring may also include a hook 57 which will engage the primary ring 43 in a manner similar to that discussed with respect to the embodiment shown in FIG. 4–7.

In some instances, it may be desired to provided a cover over the opening to a bag retained between the primary and secondary rings of the ring assemblies. To this end, the invention contemplates the use of a third ring 60 which has a greater diameter than that of the primary rings. The third ring 60 includes at least two spaced brace members 61 and 62 which will seat against the primary and inner rings of a ring assembly to thereby retain a flaccid cover thereto. The covering ring 60 may also include a hook 63 which would be engageable about either or both the inner and primary rings when in use.

Figure 2:
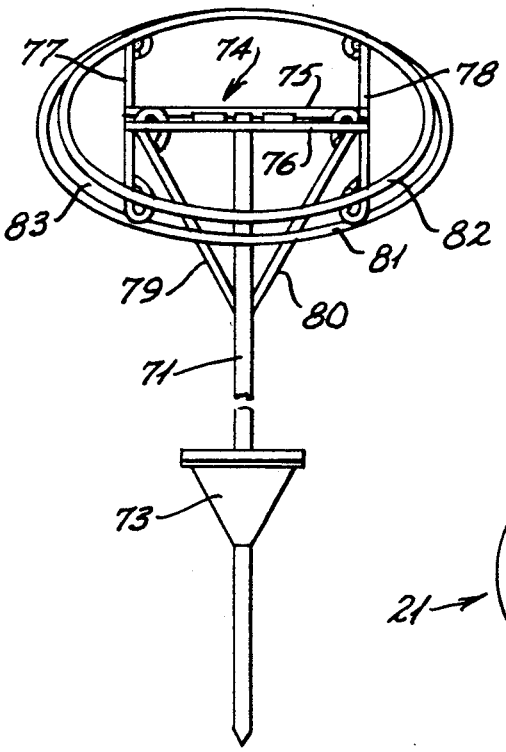
FIG. 2 in enlarged perspective view of the support rack of FIG. 1.
Figure 3:
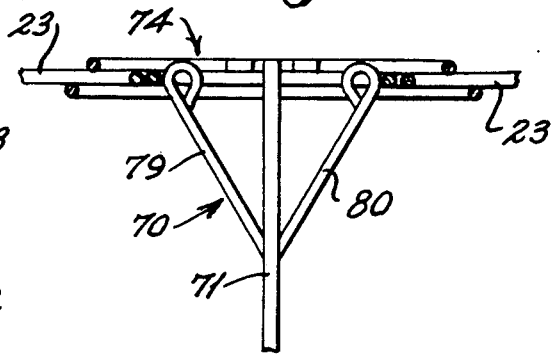
FIG. 3 is a partial cross-sectional view taken along lines 3—3 of FIG. 1.
Figure 4:
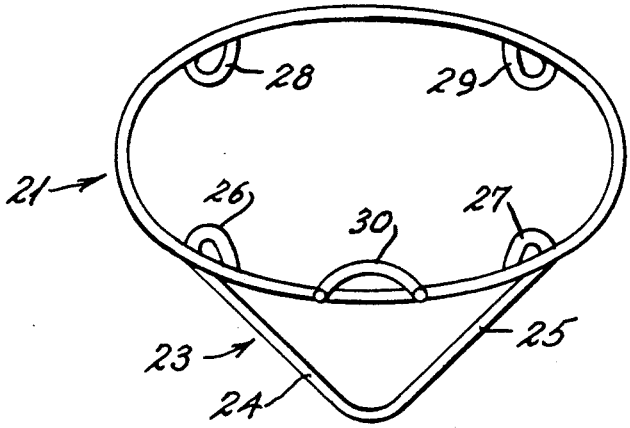
FIG. 4 is an enlarged perspective view of one of the primary rings of one of the ring assemblies of FIG. 1.
Figure 13:
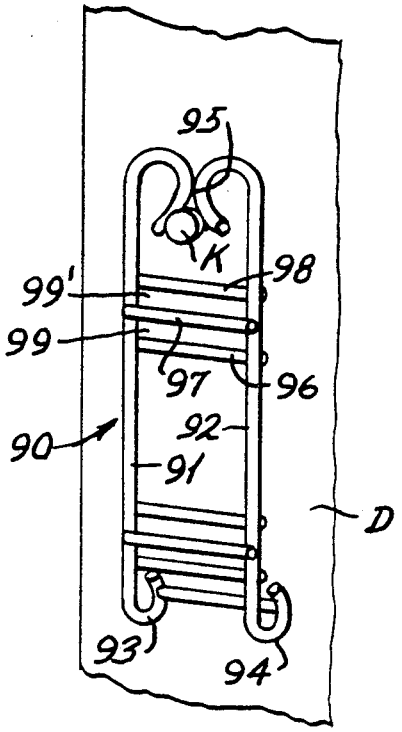
FIG. 13 is a second embodiment of support rack which may be utilized to support the ring assemblies of the present invention to a doorknob.
Figure 14:
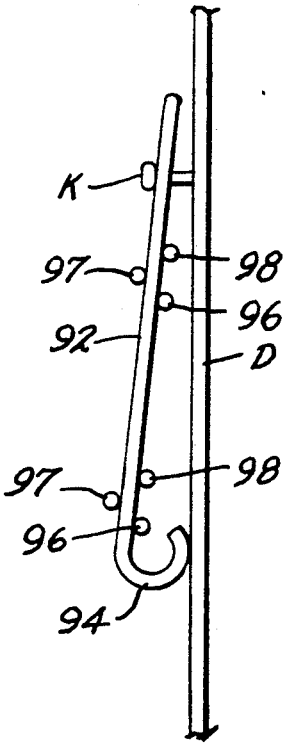
FIG. 14 is a side elevational view of the rack of FIG. 13.

With further reference to FIGS. 1–3, a first embodiment of support rack 70 is disclosed which includes a vertical post 71 having a lower tapered end 72 which is designed to be inserted in the ground by placing pressure on a foot support pedal 73. Mounted at the upper end of the post 71 is a support frame 74 having a pair of horizontally oriented rods 75 and 76 which are connected at either end of a pair of supplemental rods 77 and 78 which are connected along their intermediate portion to the upper end of the post 71. The frame 74 is reinforced by a pair of downwardly extending angle members 79 and 80 which are secured at their lower ends to an intermediate portion of the post 71.

To provide support for a plurality of ring assemblies such as those shown at 20, a pair of annular rings 81 and 82 are mounted in concentric relationship and secured to the rods 75 and 76 with the inner ring 82 being secured to the upper portion of the rods 75 and 76 and the oute ring 81 being secured to the lower portions thereof thereby defining four arcuate openings 83 therebetween. It should be noted that the lower ring 81 extends outwardly with respect to the inner ring 82 with the openings 83 being of a size to slidingly receive the brackets 23 associated with each ring assembly 20 (or the supplemental brackets 41 of the embodiment shown in FIG. 10 and brackets 49 of the embodimen shown in FIG. 11). As the thickness of the rods 75 and 76 is substantially the same as the thickness of the material from which the brackets 23 are formed, the brackets may be frictionally engaged in the openings 83 and will extend in generally horizontal orientation with respect to the ring members 81 and 82 of the mounting rack. As shown in FIG. 1, four ring assemblies are mounted within the four spaced arcuate openings 83. Each of the ring assemblies 20 i retained within the openings 83 by the weight of the ring members 21 and 22 which cause the arm portions of each bracket member 23 to bind between the rings 81 and 82 associated with the mounting bracket.

With specific reference to FIGS. 13–17 of the drawings, other embodiments of the support rack for the present invention are disclosed in greater detail. The support rack 90 of FIGS. 13 and 14 includes a pair of vertically oriented posts 91 and 92 having lower rearwardly curved ends 93 and 94, respectively, which are designed to space the rack from a door (D). The upper ends are curved inwardly and provide a notch 95 from which the bracket may be supported from a horizontally oriented member such as a doorknob (K).

To provide support for one or more ring assemblies, the support rack 96 includes sets of generally horizontally and vertically offset rods 96, 97 and 98. The rods are vertically spaced by a distance substantially equal to the thickness of the brackets (such as 23) of each of the ring assemblies so that such brackets may be slidingly received within the openings 99 and 99' defined between each of the rods. When the ring assemblies are in place, they will be retained in the same manner as described with respect to the embodiment of FIGS. 1–3.

Figure 15:
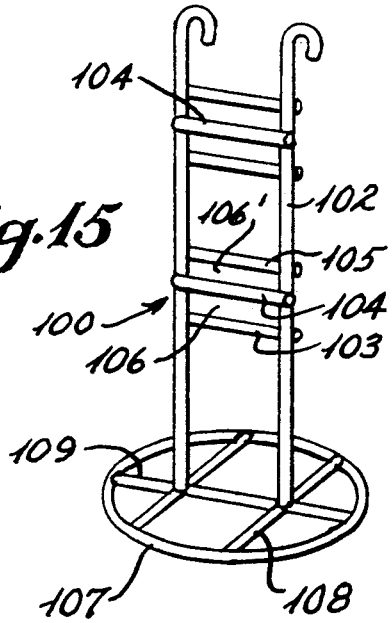
FIG. 15 is another embodiment of support rack of the present invention, wherein the rack is designed to be free standing.
Figure 16:
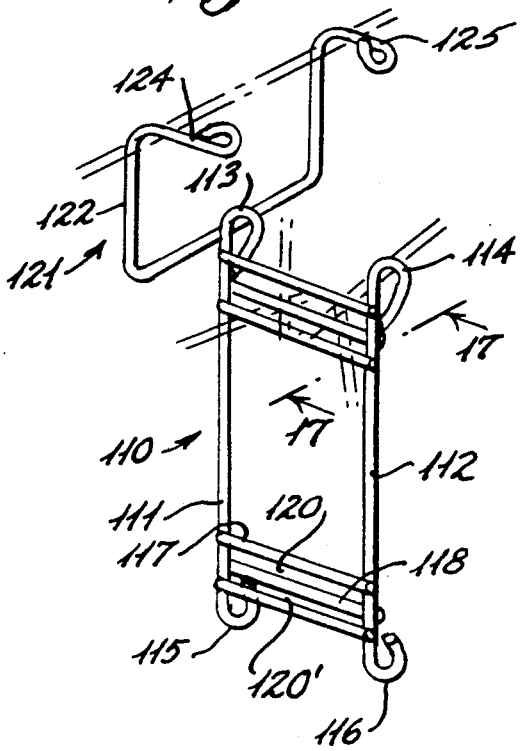
FIG. 16 is a perspective view of yet another embodiment of the present invention having a ladder-like configuration such as shown in FIGS. 13 and 15, but having supports for suspending the rack relative to a longitudinal fixture.

With respect to FIG. 15, another embodiment of support rack 100 which may be utilized with the ring assemblies of the present invention is shown in greater detail. The support rack 100 is designed to be self supporting atlhough, instead of the base shown, the rack could be constructed to be inserted in the ground. The rack includes a pair of spaced vertically oriented post elements 101 and 102 to which sets of generally horizontally and vertically offset rods 103, 104 and 105 are mounted. Opening or spaces 106 and 106' are created between each of the bars 103 104 and 105 into which the brackets (such as 23) associated with a ring assembly may be slidingly received so that the ring assembly may be cantilevered from the rods in the same manner as described with respect to the embodiments previously discussed with the exception that the ring assemblies may e supported in opposing relationship within the openings 106 and 106'. The lower ends of the posts 101 and 102 are welded to a circular base 107 having reinforcing cross members 108 and 109.

Another embodiment of support rack 110 is shown in FIG. 6. In this embodiment, the rack includes a pair of vertical posts 111 and 112 having upper and lower ends which are formed as loops 113, 114 and 115, 116, respectively. The posts 111 and 112 are connected by one or more sets of horizontal support or abutment rods 117, 118 and 119 that define openings 120 and 120' therebetween. As with the previous embodiments, the openings are of a size to permit the bracket associated with a ring assembly to be inserted therein so that the assemblies are cantilevered outwardly of the bracket. As with the brack of FIG. 15, in this embodiment, ring assembies may be inserted in opposing relationship with one another, as is shown in FIG. 17.

The upper end of the post 101 is welded or otherwise secured to a hanger bracket 121 which includes a pair of vertically oriented legs 122 and 123 from which extend a pair of arms 124 and 125 which ar used to support the hanger 121 from a horizontal handle such as the handle of lawn mower or a handle associated with a garbage container. As shown, the arms 124 and 125 are oriented outwardly with respect to the leg portions 122 and 123 and are generally parallel with respect to the orientation of the rack 100.

In this embodiment, the support rack 100 may be inverted and suspended from a post by placing the looped end portion 116 of the vertical rod 112 over a stud or nail which is driven into the post (not shown).

In each of the embodiments of the present invention, once a support rack has been placed into operative position, one or more ring assemblies may be suspended therefrom by simply inserting the bracket members associated therewith in the openings defined between the support members or bars associated with each rack. The refuse bags may be attached to each ring assembly by urging the upper edge of the bags through the primary rings associated with each assembly and thereafter the bags will be retained in an open orientation by placing the inner rings into seated engagement with the primary rings Although the rack and ring assemblies of the present invention are preferably formed of a metallic material, in some instances, it may be possible to form such elements from high density plastic materials.

I claim:

1. An apparatus for retaining refuse bags in an open and vertically elevated orientation comprising, a support rack means having at least one pair of upper and lower vertically spaced support members which define at least on opening therebetween, a ring assembly means for engagably supporting a refuse bag, said ring assembly means including a primary ring means and a secondary ring means, a bracket means connected to said primary ring means and extending outwardly therefrom, at least two lug means mounted to said primary ring means and extending inwardly thereof, said secondary ring means being of a size to be placed within the periphery of said primary ring means so as to be supported on said lug means whereby when a refuse bag is placed in an open position within said primary ring means, said bag will be retained in an open configuration by placing said secondary ring means in supported relationship with said primary ring means and said bracket means being slidably receivable within said opening between said support members so that said ring assembly means is cantilevered outwardly from said support rack.

2. The apparatus of claim 1 including a lock means mounted to said primary ring means and extending inwardly with respect thereto, said lock means being vertically spaced from said lug means by a distance which is equal to or greater than the thickness of said secondary ring means.

3. The apparatus of claim 2 in which said bracket means includes a pair of arms having inner ends, said arms being connected to said primary ring means, said inner ends of said arms extending inwardly with respect to said primary ring means so as to form seats upon which said secondary ring means may be seated.

4. The apparatus of claim 2 in which said lock means includes at least one arcuate handle means which is mounted to said primary ring means.

5. The apparatus of claim 1 in which said secondary ring means includes a hook member extending outwardly therefrom, said hook member being selectively engageable about said primary ring means when said secondary ring means is seated on said lug means.

6. The apparatus of claim 1 including a pair of ring assembly means, a supplemental bracket means secured to each of said bracket means of said ring assembly means, said supplemental bracket means being engageable within said opening between said support members so that said pair of ring assembly means are cantilevered outwardly from said support rack.

7. The apparatus of claim 1 in which said support rack means includes at least one vertical post which is engageable with the ground, said support members including a first outer ring and a second inner ring which are generally concentric with respect to one another, means for mounting said inner and outer rings to said post so as to define a plurality of openings between said inner and outer rings.

8. The apparatus of claim 1 in which said support rack means includes a pair of spaced vertical posts, a plurality of vertically spaced support members extending between said spaced vertical posts defining at least two openings therebetween, each of said openings being of a size to slidably receive said bracket means of said ring assembly means.

9. The apparatus of claim 1 in which said support rack means includes a pair o! vertically oriented members which are spaced with respect to one another, at least two pairs of upper and lower vertically spaced support members extending between said vertical members so as to define at least two openings in which said bracket means of said ring assembly means may be inserted and a hanger means for supporting said support bracket.

10. The apparatus of claim 9 in which said vertically oriented members include lower ends which extend generally perpendicularly with respect thereto, said lower end portions forming spacer means for spacing said support rack means relative to a vertical support surface.

* * * * *